US010607542B2

(12) United States Patent
Zhu et al.

(10) Patent No.: US 10,607,542 B2
(45) **Date of Patent: *Mar. 31, 2020**

(54) PIXEL CIRCUIT, PIXEL, AND AMOLED DISPLAY DEVICE COMPRISING PIXEL AND DRIVING METHOD THEREOF

(71) Applicants: KUNSHAN NEW FLAT PANEL DISPLAY TECHNOLOGY CENTER CO., LTD., KunShan, Jiangsu (CN); KUNSHAN GO-VISIONOX OPTO-ELECTRONICS CO., LTD., KunShan, Jiangsu (CN)

(72) Inventors: Hui Zhu, Kunshan (CN); Siming Hu, Kunshan (CN); Xiuqi Huang, Kunshan (CN); Ji Zhou, Kunshan (CN)

(73) Assignees: KUNSHAN NEW FLAT PANEL DISPLAY TECHNOLOGY CENTER CO., LTD., Kunshan (CN); KUNSHAN GO-VISIONOX OPTO-ELECTRONICS CO., LTD., Kunshan (CN)

( * ) Notice: Subject to any disclaimer, the term of this patent is extended or adjusted under 35 U.S.C. 154(b) by 21 days.

This patent is subject to a terminal disclaimer.

(21) Appl. No.: 16/134,737

(22) Filed: Sep. 18, 2018

(65) Prior Publication Data

US 2019/0019452 A1 Jan. 17, 2019

Related U.S. Application Data

(63) Continuation-in-part of application No. 15/109,420, filed as application No. PCT/CN2014/095331 on Dec. 29, 2014.

(30) Foreign Application Priority Data

Dec. 31, 2013 (CN) ..... 2013 1 0747565

(51) Int. Cl.
*G09G 3/3233* (2016.01)
*G09G 3/3258* (2016.01)
(Continued)

(52) U.S. Cl.
CPC ..... *G09G 3/3233* (2013.01); *G09G 3/3258* (2013.01); *G09G 3/3266* (2013.01);
(Continued)

(58) Field of Classification Search
CPC .. G09G 3/3233; G09G 3/3258; G09G 3/3266; G09G 3/3275
(Continued)

(56) References Cited

U.S. PATENT DOCUMENTS 7,180,486 B2 2/2007 Jeong
7,355,574 B1 4/2008 Leon et al.
(Continued)

FOREIGN PATENT DOCUMENTS

CN 1664901 A 9/2005
CN 1744774 A 3/2006
(Continued)

*Primary Examiner* — Fred Tzeng
(74) *Attorney, Agent, or Firm* — Maschoff Brennan

(57) ABSTRACT

A pixel circuit, a pixel, and an AMOLED (Active Matrix Organic Light-Emitting Diode) display device comprising the pixel and a driving method thereof. The pixel circuit comprises a power supply circuit, a basic circuit and a compensation circuit, which are sequentially connected. The power supply circuit is connected to a first power supply to supply power to the basis circuit. The compensation circuit is connected to second and third power supplies, respectively, for providing difference values compensating for a voltage and current of an OLED (Organic Light-Emitting Diode). The pixel comprises an OLED and the pixel circuit. The AMOLED display device comprises the pixel circuit. By compensating for a difference between threshold and
(Continued)

power supply voltages of a transistor, the response characteristics of the AMOLED may be improved to generate light of a same brightness, thereby meeting requirements on image uniformity and consistency of an AMOLED.

7 Claims, 6 Drawing Sheets

(51) Int. Cl.
*G09G 3/3266* (2016.01)
*G09G 3/3275* (2016.01)

(52) U.S. Cl.
CPC ... *G09G 3/3275* (2013.01); *G09G 2300/0819* (2013.01); *G09G 2300/0842* (2013.01); *G09G 2300/0861* (2013.01); *G09G 2310/0202* (2013.01); *G09G 2310/0243* (2013.01); *G09G 2310/0262* (2013.01); *G09G 2320/0233* (2013.01)

(58) Field of Classification Search
USPC ..... 345/215
See application file for complete search history.

(56) References Cited

U.S. PATENT DOCUMENTS

| | | | | |
|---|---|---|---|---|
| 8,294,737 | B2 | 10/2012 | Tanikame et al. | |
| 9,311,852 | B2 | 4/2016 | Wang | |
| 9,424,777 | B2 | 8/2016 | Kong et al. | |
| 9,666,112 | B2 | 5/2017 | Kim | |
| 9,704,438 | B2 | 7/2017 | Lee | |
| 2004/0174349 | A1 | 9/2004 | Libsch et al. | |
| 2006/0012310 | A1 | 1/2006 | Chen | |
| 2006/0055336 | A1* | 3/2006 | Jeong | G09G 3/3233 315/169.3 |
| 2006/0108937 | A1 | 5/2006 | Kim | |
| 2006/0221007 | A1 | 10/2006 | Kim | |
| 2007/0126663 | A1 | 6/2007 | Kim et al. | |
| 2008/0001854 | A1 | 1/2008 | Hamer et al. | |
| 2008/0001855 | A1 | 1/2008 | Hamer et al. | |
| 2009/0109147 | A1 | 4/2009 | Park et al. | |
| 2009/0295691 | A1 | 12/2009 | Handa et al. | |
| 2012/0001893 | A1 | 1/2012 | Jeong et al. | |
| 2012/0127956 | A1 | 5/2012 | WVang et al. | |
| 2012/0199854 | A1 | 8/2012 | Noguchi | |
| 2012/0248471 | A1 | 10/2012 | Kishi | |
| 2012/0287103 | A1 | 11/2012 | Wu et al. | |
| 2014/0071113 | A1 | 3/2014 | Hong et al. | |
| 2015/0229117 | A1 | 8/2015 | Kim | |
| 2015/0364089 | A1* | 12/2015 | Pyo | G09G 3/3258 345/77 |
| 2016/0063923 | A1 | 3/2016 | Yang et al. | |
| 2016/0247453 | A1 | 8/2016 | Hwang | |
| 2016/0358547 | A1* | 12/2016 | Zhu | G09G 3/3233 |

FOREIGN PATENT DOCUMENTS

| | | | |
|---|---|---|---|
| CN | 101572055 | A | 11/2009 |
| CN | 101739947 | A | 6/2010 |
| CN | 102314829 | A | 1/2012 |
| CN | 102346999 | A | 2/2012 |
| CN | 103226931 | A | 7/2013 |
| CN | 103325810 | A | 9/2013 |
| CN | 103440843 | A | 12/2013 |
| EP | 1580722 | A2 | 9/2005 |
| EP | 2 854 123 | A1 | 4/2015 |
| JP | 2006317600 | A | 11/2006 |
| JP | 2010-145579 | A | 7/2010 |

* cited by examiner

PIXEL CIRCUIT, PIXEL, AND AMOLED DISPLAY DEVICE COMPRISING PIXEL AND DRIVING METHOD THEREOF

TECHNICAL FIELD

The present invention relates to a flat panel display technology, and in particular relates to a pixel circuit, a pixel, and an active matrix organic light-emitting diode (AMOLED) comprising the pixel and a driving method thereof.

BACKGROUND

In recent years, various flat panel display devices with a smaller weight and a smaller size when compared with cathode ray transistors have been developed.

In various flat panel display devices, since active matrix organic light-emitting diode (AMOLED) display devices use a self-illuminating organic light-emitting diode (OLED) to display an image, they typically have properties such as short response time, low power consumption for driving, and a relatively better brightness and color purity. In view of this, organic light-emitting devices have become the focus of the display technology of the next generation.

With regard to a large AMOLED display device, a plurality of pixels located in a cross region of a scan line and a data line is included. Each pixel includes an OELD and a pixel circuit used for driving the OELD. The pixel circuit typically includes switch transistors, driving transistors and storage capacitors.

Since the pixel properties of AMOLEDs are influenced by the difference between driving transistors and the leakage current of the switch transistors, an image displayed by such a plurality of pixels has a relatively poor quality uniformity and consistency.

FIG. 1 is a schematic view of a pixel of an active matrix organic light-emitting diode (AMOLED) display device in the prior art. As shown in FIG. 1, the transistor of the pixel circuit 112 thereof is a PMOS transistor (a MOS transistor which has an n-type substrate and a p-channel and transfers current through hole migration).

The pixel 110 of the AMOLED display device includes: an OLED, and a pixel circuit 112 connected to a data line Dm and a scanning control line Sn1 to control the OLED.

An anode of the OLED is connected to the pixel circuit 112, and a cathode of the OLED is connected to a second power supply ELVSS. The OLED emits light with a corresponding brightness to the current intensity provided by the pixel circuit 112.

When providing a scanning control signal to the scanning control line Sn1, the pixel circuit 112 controls the amount of current provided to the OLED correspondingly to the data signal provided to a data line Dm. To this end, the pixel circuit 112 includes a second transistor T2 (i.e., a driving transistor) connected between a first power supply ELVDD and an anode of the OLED (Organic Light-Emitting Diode), a first transistor T1 (i.e., a switch transistor) connected between a gate of the second transistor T2 and the data line Dm, and a first capacitor C1 connected between the gate of the second transistor T2 and the first power supply ELVDD, wherein the gate of the first transistor T1 is connected to the scanning control line Sn1.

The gate of the first transistor T1 is connected to the scanning control line Sn1, and the source (or the drain) of the first transistor T1 is connected to the data line Dm. The drain (or the source) of the first transistor T1 is connected to one terminal of the first capacitor C1 (the other terminal thereof is connected to the first power supply ELVDD). When a scanning control signal is provided from the scanning control signal line Sn1 to the first transistor T1, the first transistor T1 is turned on, and a data signal provided from the data line Dm is provided to the first capacitor C1. At this time, a voltage corresponding to the data signal is stored in the first capacitor C1.

The gate of the second transistor T2 is connected to one terminal of the first capacitor C1 (the other terminal thereof is connected to the first power supply ELVDD), and the source of the second transistor T2 is connected to the first power supply ELVDD. The drain of the second transistor T2 is connected to the anode of the OLED. The second transistor T2 controls a current flowing to the second power supply ELVSS from the first power supply ELVDD via the OLED, and the current intensity corresponds to the voltage stored in the first capacitor C1.

One terminal of the first capacitor C1 is connected to the gate of the second transistor T2, and the other terminal of the first capacitor C1 is connected to the first power supply ELVDD, and a voltage corresponding to the data signal is charged into the first capacitor C1.

The pixel 110 controls the brightness of the OLED by adjusting the current supplied to the OLED correspondingly to the voltage discharged into the first capacitor C1, and an image with a predetermined brightness is displayed. However, in such a traditional AMOLED display device, due to the change in threshold voltage of the second transistor T2 and the leakage current of the first transistor T1, it is difficult to display an image with a uniform brightness. For example, in different pixels, due to the difference in threshold voltage of the second transistor T2 and the difference in first power supply ELVDD, the current flowing through the OLED is inconsistent when a same gate driving voltage is applied, leading to inconsistency in the brightness of the OLED. Each pixel generates light of different brightness in response to a same data signal, and as a result, the displayed image hardly has a uniform brightness.

SUMMARY

Technical Problems

With regard to this, a main objective of the present invention is to provide a pixel, an active matrix organic light-emitting diode (AMOLED) display device using the pixel and a driving method thereof. By compensating for a difference value between a threshold voltage and a power supply voltage of a transistor, the response characteristics of the AMOLED may be improved to generate light of a same brightness, thereby meeting requirements on image uniformity and consistency of an AMOLED display device.

Solution to the Technical Problems

To achieve the aforementioned object, the technical solutions of the present invention are realized as follow.

A pixel circuit 112 is provided, including a basic circuit 1122. The pixel circuit 112 also includes a power supply circuit 1121 and a compensation circuit 1123; wherein the power supply circuit 1121, the basic circuit 1122 and the compensation circuit 1123 are sequentially connected; and the power supply circuit 1121 is connected to a first power supply ELVDD to supply power to the basic circuit 1121; and the compensation circuit 1123 is connected to a second power supply ELVSS1 and a third power supply ELVSS2 respectively to compensate for a difference of a voltage and current of an OLED.

The power supply circuit 1121 is a second transistor T2; wherein the gate of the second transistor T2 is connected to a scanning control signal line Scan1, the source thereof is connected to the first power supply ELVDD, and the drain thereof is connected to the basic circuit 1122.

The basic circuit 1122 is connected to the compensation circuit 1123 via an OLED and a parasitic capacitor Coled which are connected in parallel.

The basic circuit 1122 includes a first transistor T1, a fifth transistor T5 and a first capacitor C1; wherein and a gate of the first transistor T1 is connected to a second scanning control line Scan2, the source of the first transistor T1 is connected to a data line Dm, and the drain of the first transistor T1 is connected to the gate of the fifth transistor T5; and the first capacitor C1 is connected in parallel between the gate and the source of the fifth transistor T5.

The compensation circuit 1123 includes a parasitic capacitor Coled connected in parallel to the OLED, a third transistor T3 and a fourth transistor T4; and the OLED is, after being connected in parallel to the parasitic capacitor Coled, connected in series between the drain of the fifth transistor T5 of the basic circuit 1122 and the sources of the third transistor T3 and the fourth transistor T4 of the compensation circuit 1123; and the gates of the third transistor T3 and the fourth transistor T4 are connected to an emission control line Em1 and an emission control line Em2 respectively; and the drains of the third transistor T3 and the fourth transistor T4 are connected to the second power supply ELVSS1 and the third power supply ELVSS2 respectively.

The present invention also provides a pixel in any aforementioned pixel circuit.

The present invention further provides an AMOLED display device having the pixel.

A pixel driving method is provided, including the following steps:

A: connecting to a power supply circuit (1121) and a basic circuit (1122) via a first power supply ELVDD, and connecting the basic circuit (1122) to a compensation circuit (1123) via an OLED; wherein the compensation circuit (1123) is connected to a second power supply ELVSS1 and a third power supply ELVSS2;

B: supplying power to the basic circuit (1122) by using a second transistor T2 of the power supply circuit (1121), and supplying power to the compensation circuit (1123) by using the second power supply ELVSS1 and the third power supply ELVSS2 respectively; wherein the gate of the second transistor T2 of the power supply circuit (1121) inputs a scanning control signal Scan1; the gate of the first transistor T1 of the basic circuit (1122) inputs a scanning control signal Scan2, and the source the first transistor T1 inputs a data signal Dm; and the gates of the third transistor T3 and the fourth transistor T4 of the compensation circuit (1123) input an emission control signal Em1 and an Emission control signal Em2 respectively, and the sources the third transistor T3 and the fourth transistor T4 are connected to the cathode of the OLED;

C: during a period t1 of a work cycle T of a pixel, providing a scanning control signal, and providing a first power supply voltage ELVDD by the second transistor T2 to initialize a first capacitor C1;

D: during a period t2 in which a scanning control signal Scan2 is provided to the first transistor T1, storing a voltage corresponding to the data signal Vdata provided by the first transistor T1 in the first capacitor C1; and meanwhile, turning on the first transistor T1 in response to the scanning control signal Scan2 of low level, and providing the data signal Vdata, which is provided to the data line Dm, to the gate of the fifth transistor T5 via the first transistor T1; and providing a voltage corresponding to the drain of the second transistor T2 to the anode of the OLED, and charging, by the second power supply voltage ELVSS1, which supplies power to the cathode of the OLED, the first capacitor C1 through the parasitic capacitor Coled of the OLED and the drain of the fifth transistor T5;

E: during a threshold voltage compensation period t3, causing the scanning control signal Em2 to transition to a low level, such that the fourth transistor T4 is turned on in response to the emission control signal Em2; and causing charges at the drain of the second transistor T2 to flow to the third power supply ELVSS2 along a path of the fifth transistor T5 and the anode of the OLED; when the voltage at the drain of the second transistor T2 is a threshold voltage higher than the voltage at the gate of the fifth transistor T5, turning off the fifth transistor T5, and causing charges at the drain of the second transistor T2 to stop flowing;

F: during a light-emitting period t4 of the OLED, causing the first scanning control signal Scan1 to transition to a low level; and turning on the second transistor T2 in response to the first scanning control signal Scan1, and causing the driving current to flow to the third power supply ELVSS2 along the first power supply via a path of the second transistor T2, the fifth transistor T5, the OLED and the fourth transistor T4.

During the period t1, the voltage of the second power supply ELVSS1 is further provided to the source of the third transistor T3 as a reset voltage by using the third transistor T3, such that the source of the third transistor T3 is constantly reset in each frame.

During a light-emitting period t4 of the OLED, the current Ioled flowing through the OLED is:

$$Ioled=\tfrac{1}{2}Cox(\mu W/L)(Vdata)^2;$$

where the Cox, μ, W and L represent the channel capacitance per unit area, the channel mobility, the channel width and the channel length of the fifth transistor T5 respectively, and Vdata represents a data voltage.

The current Ioled flowing through the OLED is approximately expressed as:

$$Ioled=\tfrac{1}{2}*K*[Vdata]^2$$

where k represents a constant, and Vdata represents a data voltage.

Beneficial Effects of the Present Invention

The present invention provides a pixel circuit, a pixel, and an AMOLED (Active Matrix Organic Light-Emitting Diode) display device and a driving method thereof. The present invention has advantages as follows.

With the pixel of the present invention and the AMOLED display device including the pixel, by compensating for a difference between a threshold voltage and a power supply voltage of a transistor, the response characteristics of the AMOLED may be improved to generate light of a same brightness, thereby meeting requirements on image uniformity and consistency of an AMOLED display device.

DETAILED DESCRIPTION

The pixel circuit, the pixel, and the active matrix organic light-emitting diode (AMOLED) including the pixel and the driving method thereof of the present invention will be described in detail with reference to the accompanying drawings and the embodiments of the present invention.

Herein, when a first element is described to be connected to a second element, the first element can be directly connected to the second element, or can be indirectly connected to the second element via one or more additional elements. Further, for the purpose of clarity, some elements that are not necessary for fully understanding the present invention are omitted.

Figure 1:
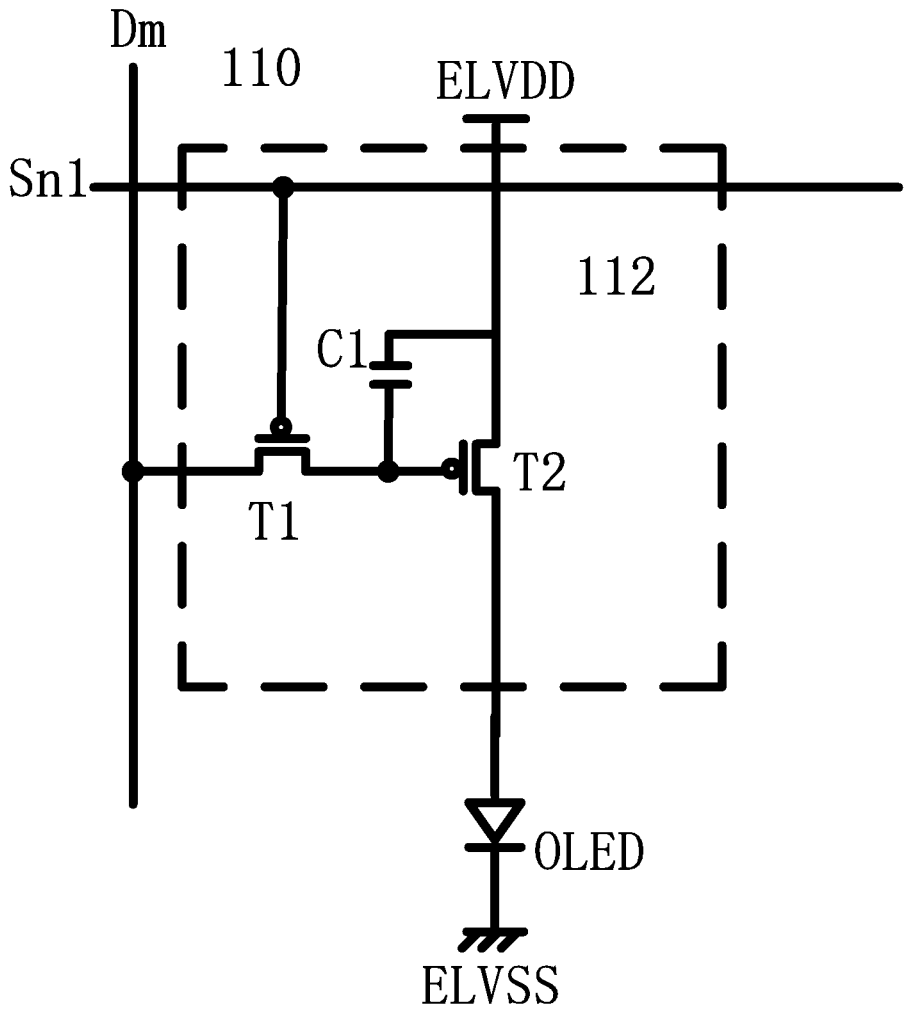
FIG. 1 is a schematic view of a pixel circuit of an active matrix organic light-emitting diode (AMOLED) in the prior art.
Figure 2:
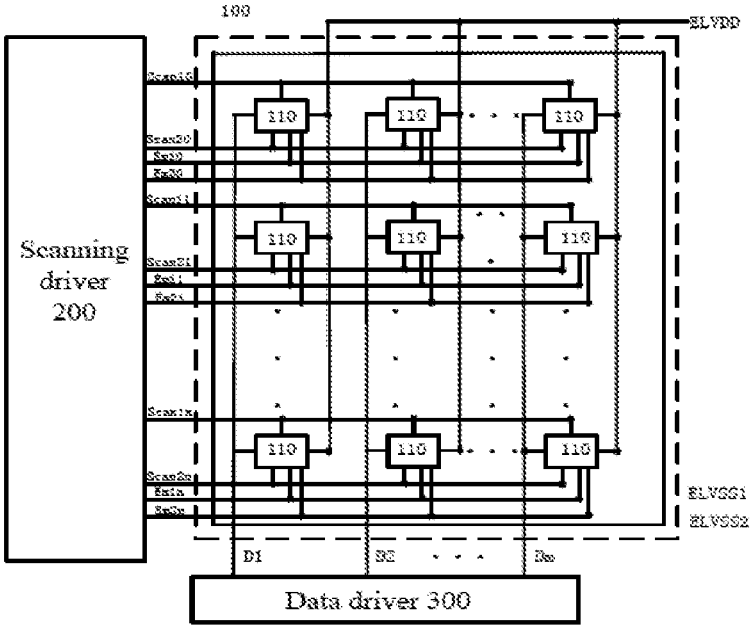
FIG. 2 is a functional block diagram of an active matrix organic light-emitting diode (AMOLED) including a pixel according to the present invention.

FIG. 2 is a functional block diagram of an active matrix organic light-emitting diode (AMOLED) including a pixel according to the present invention. As shown in FIG. 2, the AMOLED display device mainly includes a display unit 100, a scanning driver 200 and a data driver 300.

Figure 3A:
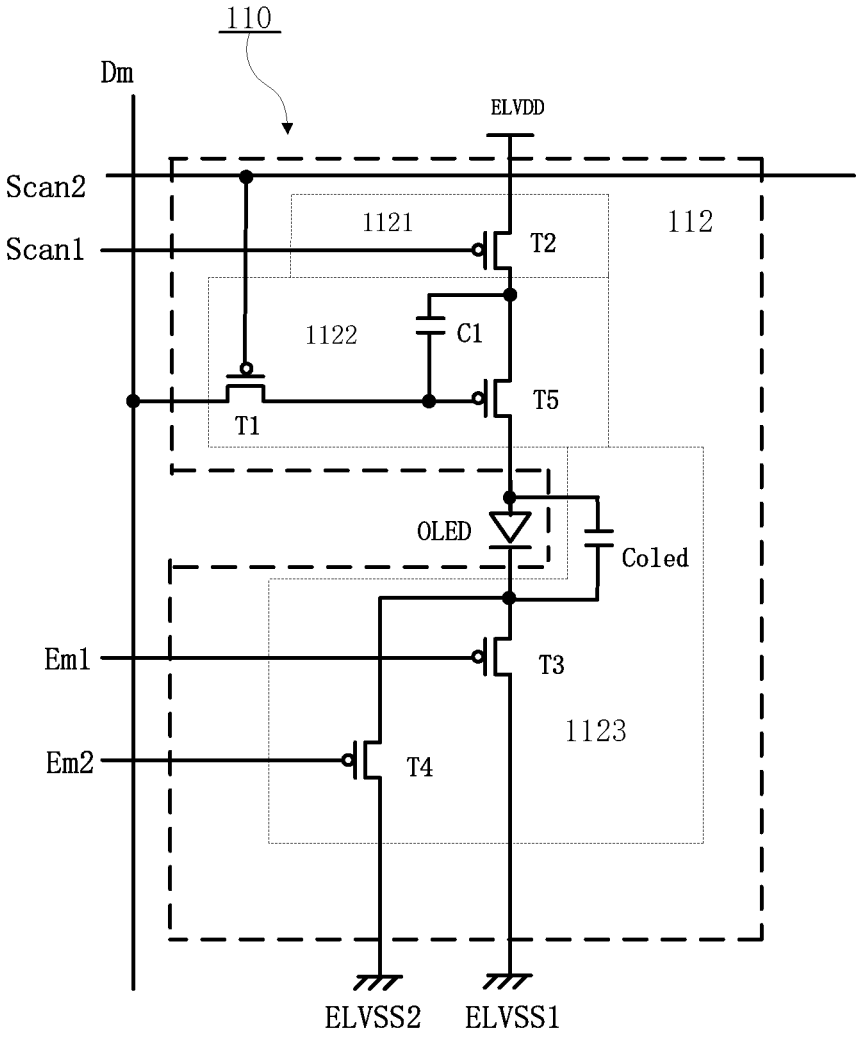
FIG. 3A is a schematic architecture diagram of the pixel of FIG. 2 in a first embodiment.
Figure 3B:
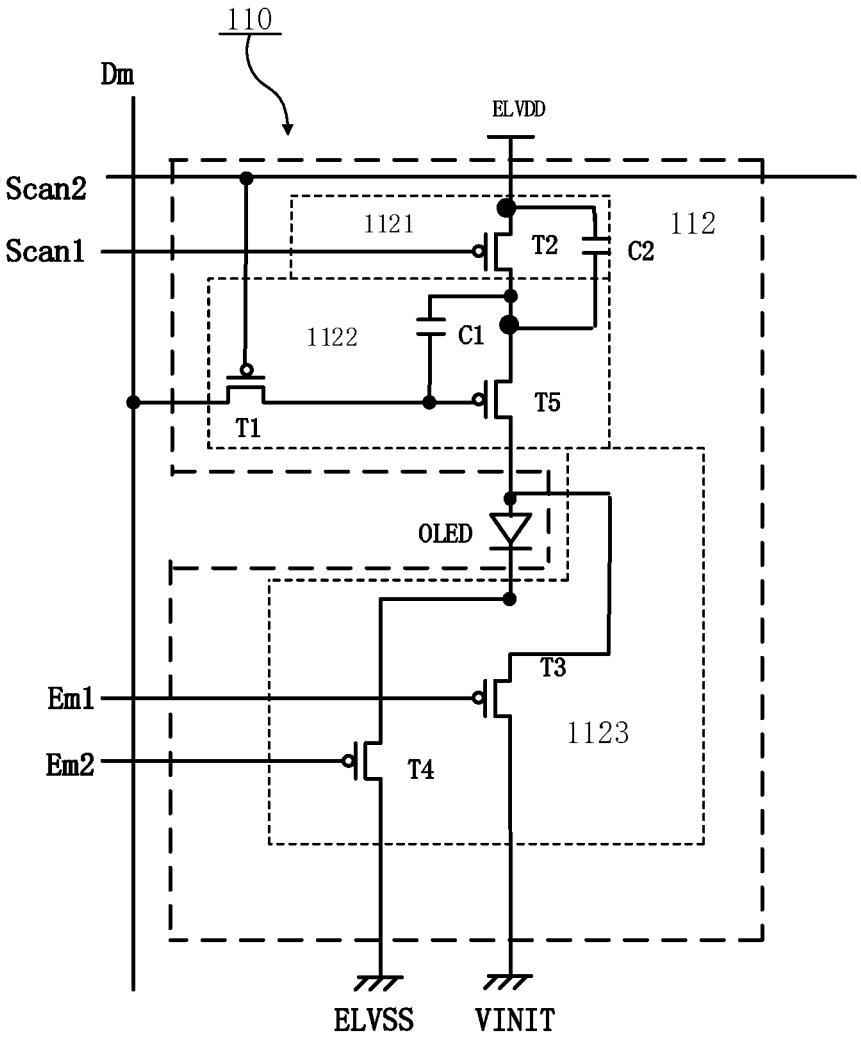
FIG. 3B is a schematic architecture diagram of the pixel of FIG. 2 in a second embodiment.

The display unit 100 includes a plurality of pixels 110 (as shown in FIG. 3A, FIG. 3B), wherein the plurality of pixels 110 are arranged in a matrix in cross regions of a scanning control line Scan1*n*, a scanning control line Scan2*n*, an emission control line Em1*n*, an emission control line Em2*n*, and a data line D1 to a data line Dm, where n is the number of a row in which a pixel is located.

Each pixel 110 is connected to a scanning control line (for example, Scan1*n*, Scan2*n*), and an emission control line (for example, Em1*n*, Em2*n*) and a data line respectively. The data line is connected on a column basis to the pixel 110 in each column of pixels respectively. For example, a pixel 110 in the $i^{th}$ row and the $j^{th}$ column is connected to scanning control lines Scan1*i* and Scan2*i* in the $i^{th}$ row, emission control lines Em1*i* and Em2*i* in the $i^{th}$ row and a data line Dj in the $j^{th}$ column.

The display unit 100 is supplied with power by an external power supply, for example, a first power supply ELVDD, a second power supply ELVSS1 and a third power supply ELVSS2. The first power supply ELVDD and the third power supply ELVSS2 are used as a voltage source of high level and a voltage source of low level respectively. The first power supply ELVDD and the third power supply ELVSS2 are used as driving power supplies for the pixel 110. The second power supply ELVSS1 is configured to compensate for the change in driving current of an organic light-emitting diode caused by fluctuation in threshold voltage of the fifth transistor T5 (referring to FIG. 3A)

The scanning driver 200 generates a scanning control signal and an emission control signal, which are both used for the pixel 110. The scanning control signal generated by the scanning controller 200 is provided to the pixel 110 sequentially from the scanning control line Scan1*i* to the scanning control line Scan1*n* respectively; and the emission control signal generated by the scanning controller 200 is provided to the pixel 110 sequentially from the emission control line Em1*i* to the emission control line Em1*n* respectively.

The data driver 300 generates data for the pixel 110 and a data signal corresponding to the data control signal. The data signal generated by the data driver 300 and the scanning signal are synchronously provided to the pixel 110 via the data line D1 to the data line Dm.

FIG. 3A is a schematic architecture diagram of the pixel of FIG. 2. The pixel as shown in FIG. 3A can be applied to the AMOLED display device as shown in FIG. 2. For ease of description, in FIG. 3A, the pixel 110 in the $n^{th}$ row and the $m^{th}$ column is exemplified for description, and a data line Dm is included.

As shown in FIG. 3A, the pixel 110 includes a pixel circuit 112 and an OLED. The pixel circuit 112 is connected between a first power supply ELVDD and a third power supply ELVSS2 for providing a driving current to the OLED (Organic Light-Emitting Diode).

The pixel circuit 112 mainly includes a power supply circuit 1121, a basic circuit 1122 and a compensation circuit 1123, which are sequentially connected.

The power supply circuit 1121 includes a second transistor T2. The gate of the second transistor T2 is connected to a first scanning control line Scan1, the source (or the drain) thereof is connected to the first power supply ELVDD, and the drain (or the source) thereof is connected to the source (or the drain) of the fifth transistor T5 in the basic circuit 1122.

The basic circuit 1122, i.e., a 2T1C circuit, is an existing common pixel circuit. The basic circuit 1122 includes a first transistor T1, a fifth transistor T5, a first capacitor C1. The gate of the first transistor T1 is connected to a second scanning control line Scan2, and the source (or the drain) of the first transistor T1 is connected the data line Dm, and the drain (or the source) thereof is connected to the gate of the fifth transistor T5. The first capacitor C1 is connected in parallel between the gate of the fifth transistor T5 and the source (or the drain) of the power supply circuit 1121. In other words, the basic circuit 1122 is connected to the drain (or the gate) of the second transistor T2 of the power supply circuit 1121 through the source (or the drain) of the fifth transistor T5.

The basic circuit 1122 is connected to the anode of the OLED in the pixel 110 through the drain (or the source) of the fifth transistor T5, and the cathode of the OLED is connected to the sources (or the drains) of the third transistor T3 and the fourth transistor T4 of the compensation circuit 1123. A parasitic capacitor Coled is connected in parallel between the anode and the cathode of the OLED, to form the compensation circuit 1123 with the third transistor T3 and the fourth transistor T4.

In the compensation circuit 1123, the drains (or the sources) of the third transistor T3 and the fourth transistor T4 are connected to the second power supply ELVSS1 and the third power supply ELVSS2 respectively. The gate of the third transistor T3 is connected to the emission control line Em1, and the gate of the fourth transistor T4 is connected to the emission control line Em2. The sources (or the drains) of the third transistor T3 and the fourth transistor T4 are of a same potential.

The first transistor, the second transistor, the third transistor, the fourth transistor and the fifth transistor as described above are all field effect transistors, and the sources and the drains thereof are the same.

When the pixel circuit 112 of the present invention works: with regard to the first transistor T1, during a period t2 in which a scanning control signal is provided to the second scanning control line Scan2, the first transistor T1 provides a data voltage Vdata to the gate of the fifth transistor.

The second transistor T2 is connected between the first power supply ELVDD and the source (or the drain) of the fifth transistor T5, and the gate of the second transistor T2 provides, by being connected to the first scanning control line Scan1, the scanning control signal to the first scanning control line Scan1 during the period t2, and at this time, the second transistor T2 in the power supply circuit 1121 is turned on, such that the first power supply ELVDD and the pixel 110 are turned on.

The third transistor T3 is connected between the cathode of the OLED and the second power supply ELVSS1, and the gate of the third transistor T3 is connected to the emission control line Em1. During a period T3 in which the scanning control signal is provided to the emission control line Em1, the third transistor T3 is turned on, such that the OLED and the second power supply voltage ELVSS1 are turned on. In this way, the pixel 110 is controlled such that the amplitude of the cathode driving voltage of the OLED is a voltage of the second power supply ELVSS1 during the initialization period t1 and the data voltage write period t2.

The fourth transistor T4 is connected between the cathode of the OLED and the third power supply ELVSS2, and the gate of the fourth transistor T4 is connected to the emission control line Em2. During a period t4 in which the scanning control signal is provided to the emission control line Em2, the fourth transistor T4 is turned on, such that the OLED and the third power supply voltage ELVSS2 are turned on. In this way, the pixel 110 is controlled such that the amplitude of the cathode driving voltage of the OLED is a voltage of the third power supply ELVSS2 during the threshold voltage compensation period t3 and the light-emitting period t4.

The fifth transistor T5 is serially connected between the second transistor T2 and the anode of the OLED, and the gate of the fifth transistor T5 is connected to the drain (or the source) of the first transistor T1. When the second scanning control signal Scan2 provided from the scanning control line transitions to a low level, the first transistor T1 is turned on, and the data signal is sent to the gate of the fifth transistor T5 through the first transistor T1.

The first capacitor C1 is connected between the drain (or the source) of the second transistor T2 and the gate of the fifth transistor T5. In conjunction with FIG. 4A, during the period t1 in which the scanning control signal is provided to the scanning control line Scan1, a first power supply voltage ELVDD is provided through the second transistor T2 to initialize the first capacitor C1. Then, during the period t2 in which the scanning control signal is provided to the second scanning control line Scan2, a voltage corresponding to the data signal provided through the first transistor T1 is stored in the first capacitor C1.

The OLED is serially connected between the drain (or the source) of the fifth transistor T5 and the source (or the drain) of the third transistor T3. During the light-emitting period t4 of the OLED, the OLED will emit light with a corresponding intensity to the intensity of the driving current provided through the first power supply ELVDD, the fifth transistor T5, the second transistor T2 and the fourth transistor T4.

In pixel 110, due to inconsistency of the threshold voltage of a driving transistor (for example, the fifth transistor T5), the current flowing through the OLED is also inconsistent. As a result, the consistency of brightness of the pixel 110 becomes poor, and the image non-uniformity is finally caused. However, by the addition of the fourth transistor T4 and the third transistor T3, the change in threshold voltage of a driving transistor (for example, the fifth transistor T5) is compensated for during the initialization period t1 of each frame, so that the product defect of image non-uniformity resulted from the aforementioned poor uniformity of brightness of the pixel 110 may be avoided.

Figure 4A:
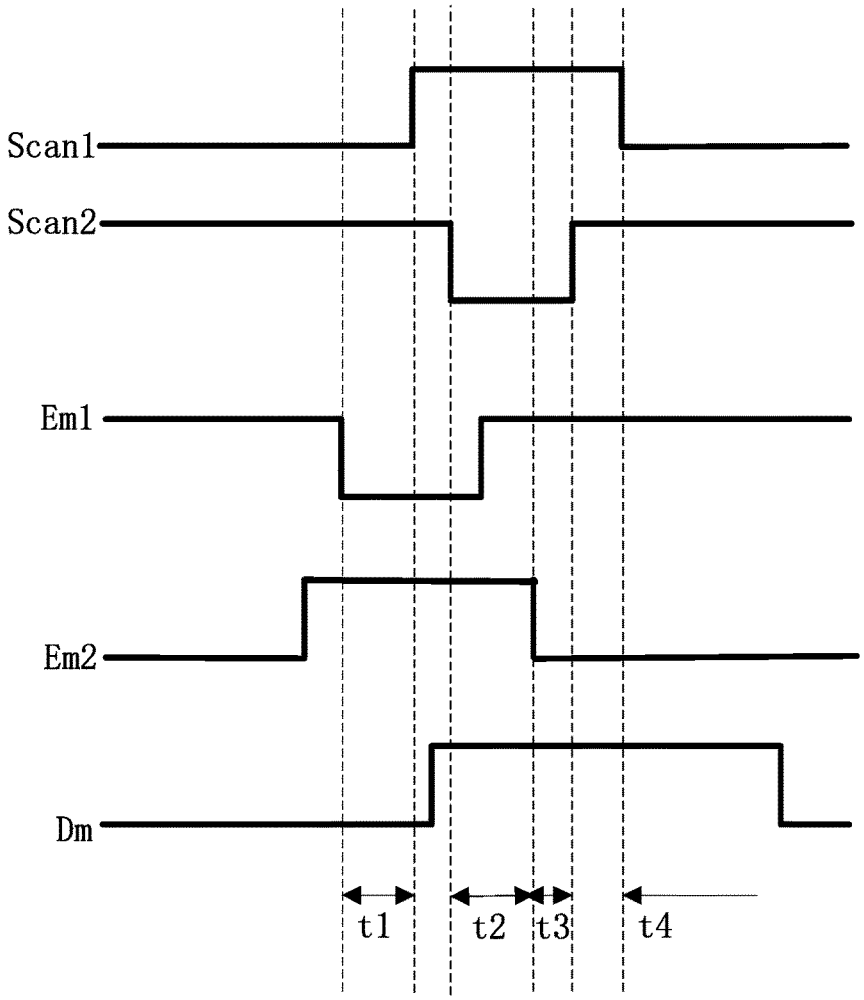
FIG. 4A is a waveform diagram of a driving signal for driving the pixel of FIG. 3A in the first embodiment.

FIG. 4A is a waveform diagram of a driving signal for driving the pixel of FIG. 3A. For ease of description, FIG. 4A shows a waveform of a driving signal provided by the pixel of FIG. 3A during a frame signal period 4. The driving process of the pixel will be described with reference to FIG. 3A.

The first scanning control signal Scan1 configured to control the second transistor T2 to control the ON-connection between the second transistor T2 and the first power supply ELVDD.

The scanning control signal is configured to control the first transistor T1 to write a data level.

The emission control line Em1 is configured to control the third transistor T3 to control the ON-connection between the third transistor T3 and the second power supply ELVSS1.

The emission control line Em2 is configured to control the fourth transistor T4 to control the ON-connection between the fourth transistor T4 and the third power supply ELVSS2.

As shown in FIG. 4A, during a period set to perform initialization, i.e., period t1, first, a first scanning control signal Scan1 of low level is provided to the pixel 110. Thus, the second transistor T2 is turned on through the first scanning control signal Scan1 of low level, such that the voltage of the first power supply ELVDD is provided to the source (or the drain) of the fifth transistor T5. An emission control signal Em1 of low level is provided to the pixel 110. Thus, the third transistor T3 is turned on through the emission control signal Em1 of low level, such that the voltage of the second power supply ELVSS1 is provided to the source (or the drain) of the third transistor T3.

With reference to FIG. 3A, during the period t1, the voltage of the second power supply ELVSS1 may be also provided to the source (or the drain) of the third transistor T3 as a reset voltage by the third transistor T3, so as to constantly reset the source (or the drain) of the third transistor T3 in each frame.

Then, during the period t2 set to perform data voltage writing (i.e., a stage for writing a data voltage), a second scanning control signal Scan2 of low level is provided to the pixel 110. Then, the first transistor T1 is turned on in response to the second scanning control signal Scan2 of low level. Thus, a data signal Vdata provided to the data line Dm is provided to the gate of the fifth transistor T5 via the first transistor T1. At this time, since the fifth transistor T5 is in an ON state, a voltage corresponding to the drain (or the source) of the second transistor T2 is provided to the anode of the OLED. However, the second power supply voltage ELVSS1 provided to the cathode of the OLED supplies power to the first capacitor C1 through the parasitic capacitor Coled of the OLED and the drain (or the source) of the fifth transistor T5.

Figure 5A:
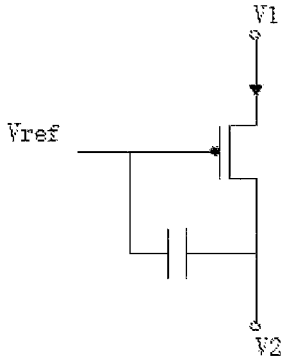
FIGS. 5A and 5B are diagrams of two types of driving TFT programming
Figure 5B:
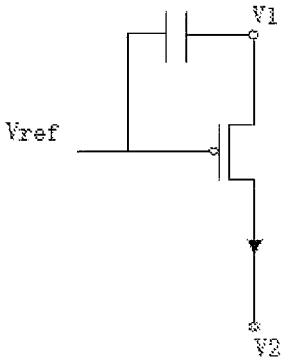

Then, perform the threshold voltage compensation stage. FIG. 5A and FIG. 5B are diagrams of two types of driving TFT programming. As seen in FIG. 5A, in the common N-Type TFT programming mode, the driving transistor is an NMOS transistor, and the capacitor C1 is usually disposed between the gate and the drain of the NMOS transistor. In the Vth programming phase, the initial voltage of V2 is low.

Then the TFT is turned on, and the current flows from V1 to V2. When the V2 rises to Vdata−Vth, the driving TFT is turned off.

As seen in FIG. 5B, in the common P-Type TFT programming mode, the driving TFT is an PMOS TFT, and the capacitor C1 is usually disposed between the source and the gate of the PMOS TFT. In the Vth programming phase, the initial voltage of V1 is high. Then the TFT is turned on, and the current flows from V1 to V2. When the V2 is lowered to Vdata−Vth, the driving TFT is turned off. Therefore, it is effective to store the voltage value associated with Vth at the source node of the driving TFT. This also enables the voltage value associated with and Vdata to be stored in the capacitor C1.

During the period t3 set to perform threshold voltage compensation (i.e., threshold compensation), the emission control signal Em2 transitions to a low level. Then, the fourth transistor T4 is turned on in response to the emission control signal Em2, and charges at the drain (or the source) of the second transistor T2 flow to the third power supply ELVSS2 along a path of the fifth transistor T5 and the anode of the OLED; when the voltage at the drain (or the source) of the second transistor T2 is one default voltage higher than the voltage at the gate of the fifth transistor T5 a certain volume as to the P-type TFT referred in this embodiment, the voltage of T5 is lowered to Vdata−Vth, the fifth transistor T5 is turned off, and charges at the drain (or the source) of the second transistor T2 stop flowing. Optionally, as to the N-type, TFT, the voltage of T5 rises to Vdata+Vth, the fifth transistor T5 is turned off.

Herein, a voltage of the fifth transistor T5 corresponding to the threshold voltage and the Vdata provided to the fifth transistor T5 is stored in the first capacitor C1, such that the threshold voltage of the fifth transistor T5 is compensated for during the period T3.

At last, during the period t4 set to emit light (i.e., the light-emitting stage), the first scanning control signal Scan1 transitions to a low level. Then, the second transistor T2 is turned on in response to the first scanning control signal Scan1. Thus, the driving current flows to the third power supply ELVSS2 along the first power supply ELVDD via a path of the second transistor T2, the fifth transistor T5, the OLED and the fourth transistor T4. The current holed flowing through the organic light-emtting diode (OLED) is:

$$\text{Ioled}=\tfrac{1}{2}Cox(\mu W/L)(V\text{data})\hat{}2;$$

where Cox, μ, W and L represent the channel capacitance per unit area, the channel mobility, the channel width and the channel length of the fifth transistor T5 respectively, and Vdata represent a data voltage.

The current flowing through the OLED can be approximately expressed as:

$$\begin{aligned} Ioled &= 1/2*K*[Vsg-|Vth|]\hat{}2 \\ &= 1/2*K*[Vdd-(Vdd-Vc1)-|Vth|]\hat{}2 \\ &= 1/2*K*[|Vth|+(1-N)/N*Vdata-|Vth|]\hat{}2 \\ &= 1/2*K*[(1-N)/N*Vdata]\hat{}2 \\ &= 1/2*K*[Vdata]\hat{}2, \end{aligned}$$

where k is Cox*μ*W*L, which is a constant; and Vsg is the voltage difference between a source and a gate; Vth represents a threshold voltage; Vdd represents the first power supply voltage ELVDD; Vcl represents a voltage stored in the first capacitor C1; Vdata represents a data voltage; and N is a natural number greater than 1.

The circuit referred in the second embodiment shown in FIG. 3B is similar to that referred in the first embodiment shown in FIG. 3A. The power supply circuit 1121 includes a second transistor T2 connected between the first power supply ELVDD and the source of the fifth transistor T5 The basic circuit includes a second capacitor C2, one end of the second capacitor C2 is connected to the source of the second transistor T2 and the other end is connected to the drain of the second transistor T2. The compensation circuit is connected to a power supply ELVSS and a direct current power supply VINIT, to compensate for a change in current of an OLED caused by a change in threshold voltage of a transistor.

Figure 4B:
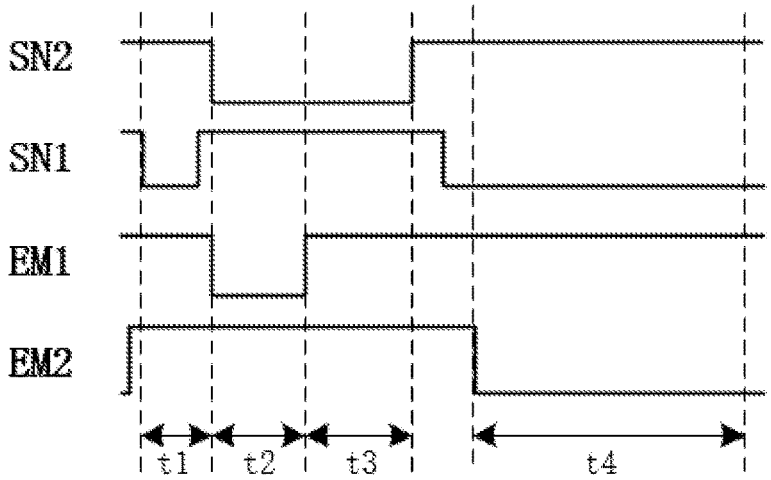
FIG. 4B is another waveform diagram of a driving signal for driving the pixel of FIG. 3B in the second embodiment.

FIG. 4B is a waveform diagram of a driving signal for driving the pixel of FIG. 3B. FIG. 4B also shows a waveform of a driving signal provided by the pixel of FIG. 3B during a frame signal period 4.

During a period t1, the second transistor T2 is turned on to initialize the source of T5;

During a period t2, scan 2 and EM1 is changed to a low level. The voltage of DM is referred into Vref. Vref is provided to the gate of the fifth transistor T5 via the first transistor T1. The direct current power supply VINIT is provided to the anode of OLED via the third transistor T3. Scan 1 is changed to high level. The second transistor T2 is turned off. The fifth transistor T5 discharges via the source thereof, till the voltage of the source of T5 is lowered to Vref−Vth. The contrast of the OLED could be improved. In period t3, scan 2 keeps low level, T1 turns on, and the voltage of DM becomes Vdata. The voltage of the source of T5 becomes (Vref−Vth)+(C1/(C1+C2))*(Vdata−Vref). The difference between the voltage of the gate and the voltage of the source becomes (C1/(C1+C2))*(Vdata−Vref)+Vth. C1 represents the capacitance of the first capacitor, C2 represents the capacitance of the second capacitor.

In period t4, scan 1 and EM 2 become low level, and the transistor T2 and T4 turn on. The current flowing through the OLED can be approximately expressed as:

$$\begin{aligned} Ioled &= 1/2*K*(Vgs-Vth)\hat{}2 \\ &= 1/2*K*((C2/(C1+C2)*(Vdata-Vref))\hat{}2 \end{aligned}$$

Described above are merely preferred embodiments of the present invention, but are not intended to limit the protection scope of the present invention.

The invention claimed is:

1. A pixel circuit, comprising:

a basic circuit, a power supply circuit connected to a first power supply to supply power to the basic circuit, and a compensation circuit including a third transistor and a fourth transistor, and connected to a second power supply and a direct current power supply to compensate for a change in current of an organic light emitting diode caused by a change in threshold voltage of a transistor, the power supply circuit, the basic circuit and the compensation circuit being sequentially connected, wherein the direct current power supply is connected to an anode of the organic light emitting diode via the third transistor, a gate of the third transistor is connected to a first emission control line, the second power supply is connected to a cathode of the organic light emitting diode via the fourth transistor, and a gate of the fourth transistor is connected to a second emission control line.

2. The pixel circuit according to claim 1, wherein the power supply circuit includes a second transistor comprising a gate connected to a first scanning control signal line, a source connected to the first power supply, and a drain connected to the basic circuit.

3. The pixel circuit according to claim 1, wherein the basic circuit is connected to the compensation circuit via the organic light emitting diode.

4. The pixel circuit according to claim 1, wherein the basic circuit comprises a first transistor, a fifth transistor and a first capacitor, the first transistor includes a gate connected to a second scanning control line, a source is connected to a data line, and a drain connected to a gate of the fifth transistor, and the first capacitor is connected in parallel between the gate of the fifth transistor and a source of the fifth transistor.

5. The pixel circuit according to claim 4, wherein the basic circuit comprises a second capacitor, one end of the second capacitor is connected to the source of the second transistor and the other end is connected to the drain of the second transistor.

6. An AMOLED display device comprising a pixel having a pixel circuit as defined in claim 1.

7. A pixel driving method, comprising the following steps:

A: connecting a basic circuit to a first power supply via a power supply circuit, and connecting the basic circuit to a compensation circuit via an organic light emitting diode; wherein the compensation circuit is connected to a second power supply and a direct current power supply;

B: supplying power to the basic circuit by using a second transistor of the power supply circuit, and supplying power to the compensation circuit by using the second power supply and the direct current power supply; wherein a gate of the second transistor of the power supply circuit inputs a first scanning control signal; a gate of a first transistor of the basic circuit inputs a second scanning control signal; a source of the first transistor inputs a data signal Vdata or a reference signal Vref from a data line; gates of a third transistor and a fourth transistor of the compensation circuit input a first emission control signal and a second emission control signal respectively; and a source of the third transistor is connected to the anode of the organic light emitting diode and a source of the fourth transistor is connected to a cathode of the organic light emitting diode;

C: during a first period of a work cycle of a pixel, providing a first scanning control signal, and providing a first power supply voltage by the second transistor to initialize a first capacitor, the first capacitor connected between a drain of the second transistor and a gate of a fifth transistor;

D: during a second period in which the second scanning control signal is provided to the first transistor, providing a voltage Vref of the data line to a gate of the fifth transistor via the first transistor, wherein the fifth transistor discharges via the source thereof, till the voltage of the source of the fifth transistor is lowered to Vref−Vth;

E: during a threshold voltage compensation period, causing the second scanning control signal to keep low level to turn on the first transistor, with the voltage of data signal becoming Vdata; and F: during a light-emitting period of the organic light emitting diode, causing the first scan signal and the second emission control line to low level, to turn on the second transistor and the fourth transistor, wherein during the light-emitting period of the organic light emitting diode, the current flowing through the OLED is:

$$Ioled=\tfrac{1}{2}*K*(Vgs-Vth)\hat{}2=\tfrac{1}{2}*K*((C2/(C1+C2)*(Vdata-Vref))\hat{}2,$$

wherein Cox, μ, W and L represent the channel capacitance per unit area, the channel mobility, the channel width and the channel length of the fifth transistor T5 respectively, Vdata represents a data voltage, C1 represents a capacitance of the first capacitor, and C2 represents a capacitance of the second capacitor.

* * * * *